US012215404B1

(12) United States Patent
Xiong et al.

(10) Patent No.: US 12,215,404 B1
(45) Date of Patent: Feb. 4, 2025

(54) CARBIDE-FREE TEMPERED MARTENSITIC STEELS AND PREPARATION METHODS THEREOF

(71) Applicant: BEIJING INSTITUTE OF TECHNOLOGY, Beijing (CN)

(72) Inventors: Zhiping Xiong, Beijing (CN); Dezhen Yang, Beijing (CN); Chao Zhang, Beijing (CN); Hao Zhang, Beijing (CN); Xingwang Cheng, Beijing (CN)

(73) Assignee: BEIJING INSTITUTE OF TECHNOLOGY, Beijing (CN)

( * ) Notice: Subject to any disclaimer, the term of this patent is extended or adjusted under 35 U.S.C. 154(b) by 0 days.

(21) Appl. No.: 18/401,294

(22) Filed: Dec. 29, 2023

(30) Foreign Application Priority Data

Aug. 1, 2023 (CN) ..... 202310957934.3

(51) Int. Cl.

| | |
|---|---|
| ***C21D 9/46*** | (2006.01) |
| ***C21D 1/18*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |

(Continued)

(52) U.S. Cl.

CPC ..... *C21D 9/46* (2013.01); *C21D 1/18* (2013.01); *C21D 6/001* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/38* (2013.01); *C21D 2211/001* (2013.01); *C21D 2211/008* (2013.01); *C21D 2211/009* (2013.01)

(58) Field of Classification Search

None

See application file for complete search history.

(56) References Cited

FOREIGN PATENT DOCUMENTS

| | | | |
|---|---|---|---|
| CN | 105734213 | A | 7/2016 |
| CN | 105506494 | B | 8/2017 |
| CN | 105018859 | B | 9/2017 |

(Continued)

OTHER PUBLICATIONS

First Office Action in Chinese Application No. 202310957934.3 mailed on Dec. 29, 2023, 16 pages.

(Continued)

*Primary Examiner* — Anthony M Liang

(74) *Attorney, Agent, or Firm* — Porus IP LLC

(57) ABSTRACT

The embodiments of the present disclosure provide a carbide-free tempered martensitic steel and a preparation method thereof. The carbide-free tempered martensitic steel includes a martensite matrix without carbide and a retained austenite distributed between the martensite matrix obtained after tempering or partitioning. A size of retained austenite (Continued)

is submicron or nanoscale, a morphology of retained austenite includes at least one of sphere, block, or film, and a volume fraction of the retained austenite is in a range of 10%-40%.

7 Claims, 8 Drawing Sheets

(51) Int. Cl.
*C22C 38/12* (2006.01)
*C22C 38/38* (2006.01)

(56) References Cited

FOREIGN PATENT DOCUMENTS

| | | | | | |
|---|---|---|---|---|---|
| CN | 106244918 | B | | 4/2018 | |
| CN | 105874086 | B | | 7/2018 | |
| CN | 110468263 | A | | 11/2019 | |
| CN | 108004468 | B | | 5/2020 | |
| CN | 113061698 | A | * | 7/2021 | ..... C21D 1/18 |
| CN | 113652612 | A | | 11/2021 | |
| WO | 2022206911 | A1 | | 10/2022 | |

OTHER PUBLICATIONS

Sun, W.W. et al., Advanced High Strength Steel (AHSS) Development through Chemical Patterning of Austenite, Scripta Materialia, 146: 60-63, 2018.

Yang, Dezhen et al., Lamellar Pearlite as an Initial Microstructure for Austenite Reversion Treatment, Journal of Materials Engineering and Performance, 30(2): 1330-1339, 2021.

Yang, Dezhen et al., Evolution of Microstructures and Mechanical Properties with Tempering Temperature of A Pearlitic Quenched and Tempered Steel, Journal of Iron and Steel Research International, 2021, 11 pages.

Yang, Dezhenet al., Mn Heterogeneity and Ductility Improvement Realized by Slow Heating Mn-partitioned Pearlite, Metals and Materials International, 2023, 10 pages.

Zhang, Chao et al., Heterogeneous Quenching and Partitioning from Manganese-Partitioned Pearlite: Retained Austenite Modification and Formability Improvement, Acta Materialia, 235: 1-18, 2022.

Xiong, Zhiping et al., Carbide-free Tempered Martensite in Fe—C Steels, Journal of Materials Science & Technology, 179: 22-25, 2024.

* cited by examiner

CARBIDE-FREE TEMPERED MARTENSITIC STEELS AND PREPARATION METHODS THEREOF

CROSS-REFERENCE TO RELATED APPLICATION

This application claims priority of Chinese Patent Application No. 202310957934.3, filed on Aug. 1, 2023, the entire content of which is incorporated herein by reference.

TECHNICAL FIELD

The present disclosure relates to the technical field of heat treatment of material, and in particular, to a carbide-free tempered martensitic steel and a preparation method thereof.

BACKGROUND

Normally, the martensitic steel requires tempering to improve its ductility and toughness. Nevertheless, during the transition from low-temperature to high-temperature tempering, the supersaturated carbon atoms within the martensitic steel can gradually form carbon segregation, transition carbides, cementite, and even alloy carbides, which will inevitably precipitate carbides within the martensitic steel. Carbide precipitation cannot be avoided during tempering even in the case of very low carbon content. An instance is the Chinese patent No. CN105506494B, discloses a preparation method thereof to prepare high-toughness & high-strength hot-rolled steel with a yield strength of 800 MPa and, wherein a high-strength steel with an ultra-low carbon lath martensite microstructure is obtained through direct quenching or a low-temperature coiling process using a hot continuous rolling process. The carbon content of the high-strength steel is only in a range of 0.02%-0.05%, but its martensite still contains a certain amount of carbides.

The adverse effects of carbide on steel mainly includes two aspects. (1) Brittle and hard carbides can hinder the movement of dislocations during deformation and form stress concentration at the interface of carbide and martensite matrix, resulting in the formation of holes and cracks, that is, the carbides tend to become initiation points of holes or even crack nucleation, which reduces the ductility of steel during deformation. Simultaneously, the formation of film cementite along the martensite lath boundary can lead to significant reduction in the toughness of steel and induce tempered martensite embrittlement. In practice, it is found that brittle transgranular fracture often occurs when the cementite within the martensitic lath is coarsened. (2) The presence of carbide precipitation in martensitic steel can lead to a decrease in the carbon content of the austenite, causing instability of the austenite at room temperature. In particular, for a Quenching and Partitioning Steel (Q&P Steel) whose stability of metastable austenite is by diffusing carbon from martensite to austenite so that it can be retained at room temperature. Therefore, if the carbide precipitation occurs during the partitioning stage, a large amount of available carbon may be consumed, resulting in the carbon of Q&P steel being unable to full partition into austenite, and eventually sufficient retained austenite cannot be obtained to ensure high ductility of the steel.

In the prior art, the addition of Si and Al into Q&P steels improves the carbon partitioning between martensite and austenite due to the inhibition of carbide precipitation from martensite during tempering, thus obtaining retained austenite (RA) at the room temperature. However, the addition of Si and Al still may not completely inhibit the precipitation of transition carbides, and may also lead to a decrease in other application properties of steel. For example, Si addition is detrimental to galvanization because it can suppress Fe—Zn alloying reaction. In addition, the addition of Si promote the segregation of phosphorus at grain boundaries duo to the repulsion between Si and phosphorus, which is harmful to impact toughness. Al may reduce casting performance duo to causes nozzle clogging during casting. Therefore, further develop of new methods for manufacturing the martensitic steel that inhibit the precipitation of carbide is still necessary.

The prior arts (e.g., W. W. Sun, Y. X. Wu, S. C. Yang, C. R. Hutchinson, Advanced high strength steel (AHSS) development through chemical patterning of austenite, Scripta Materialia 146 (2018) 60-63; D. Z. Yang, C. Zhang, X. W. Cheng, Z. P. Xiong, Lamellar pearlite as an initial microstructure for austenite reversion treatment, Journal of Materials Engineering and Performance 30 (2021) 1330-1339; D. Z. Yang, Z. P. Xiong, C. Zhang, G. Z. Feng, Z. F. Cheng, X. W. Cheng, Evolution of microstructures and mechanical properties with tempering temperature of a pearlitic quenched and tempered steel, Journal of Iron and Steel Research International 29 (2022) 1393-1403; D. Z. Yang, J. S. Xiao, C. Zhang, Y. C. Wang, Z. P. Xiong, Mn heterogeneity and ductility improvement realized by slow heating Mn-partitioned pearlite, Metals and Materials International (2023) 260596924; C. Zhang, Z. P. Xiong, D. Z. Yang, X. W. Cheng, Heterogeneous quenching and partitioning from manganese-partitioned pearlite: retained austenite modification and formability improvement, Acta Materialia 235 (2022) 118060) disclose a complex microstructure composed of alternative Mn-enriched film RA and Mn-depleted lath martensite, which is formed through fast heating and short austenitization from Mn-partitioned pearlite consisting of Mn-depleted ferrite and Mn-riched cementite, thereby regulating the stability, morphology and content of RA. However, the role of the Mn content and the size of austenite and martensite in inhibiting the precipitation of carbide and promoting the diffusion of carbon from martensite to austenite is ignored. At the same time, it has been found in practice that problems still exist in the prior arts as follows. (1) After tempering, carbide still precipitate in the martensite. (2) Its preparation to form the single C-rich and Mn-rich nano-film RA would limit a final RA content of the material, and at the same time, excessively high stability of the film RA makes it difficult to exert transformation-induced plasticity effect (TRIP), which limits the further improvement of the ductility of the material. Therefore, the technical challenge that remains to be addressed is how to further accurately control the precipitation of carbide, and regulate the content, morphology, and stability of RA, so as to expand a process window to be suitable for industrial production.

SUMMARY

In view of the shortcomings of the prior arts, the present disclosure provides a carbide-free tempered martensitic steel and a preparation method thereof.

One embodiment of the present disclosure provides a carbide-free tempered martensitic steel. The carbide-free tempered martensitic steel includes a martensite matrix without carbide and a retained austenite distributed between the martensite matrix obtained after tempering or partitioning, wherein a size of the retained austenite is submicron or nanoscale; a morphology of the retained austenite includes at least one of sphere, block, or film; and a volume fraction of the retained austenite is in a range of 10%-40%.

In some embodiments, the carbide-free tempered martensitic steel includes Fe, C, and Mn elements, wherein a mass percentage of the C is in a range of 0.2%-1.0%; and a mass percentage of the Mn is in a range of 2.0%-8.0%.

In some embodiments, the carbide-free tempered martensitic steel consists of Fe, C, Mn elements, and unavoidable impurities.

In some embodiments, the carbide-free tempered martensitic steel further includes at least one of Si with a mass percentage of 0-3%, Al with a mass percentage of 0-3%, Cr with a mass percentage of 0-1.5%, Mo with a mass percentage of 0-0.5%, Ni with a mass percentage of 0-2%, Ti with a mass percentage of 0-0.1%, V with a mass percentage 0-0.5%, or Nb with a mass percentage of 0-0.5%.

In some embodiments, an atomic percentage of Mn in the retained austenite is greater than an atomic percentage of Mn in the martensite matrix, and a difference in the atomic percentage of Mn between the retained austenite and the martensite matrix is greater than 3 at. %.

In some embodiments, the atomic percentage of Mn in the retained austenite is greater than or equal to 4 at. %. In some embodiments, a spacing between adjacent retained austenites is smaller than or equal to 2 μm.

In some embodiments, a tensile strength of the carbide-free tempered martensitic steel is in a range of 1500 MPa-2200 MPa, and a total elongation of the carbide-free tempered martensitic steel is in a range of 10%-30%.

One embodiment of the present disclosure provides a method for preparing a carbide-free tempered martensitic steel. The method for preparing the carbide-free tempered martensitic steel includes obtaining a first steel with heterogeneous distribution of Mn as a prefabricated product; obtaining a second steel with heterogeneous distribution of Mn in the high-temperature austenite by heating the prefabricated product to a first temperature at a first heating rate and holding for first preset time; and obtaining the carbide-free tempered martensitic steel by performing tempering on the steel with the heterogeneous distribution of Mn in the high-temperature austenite after cooling to a room temperature, or partitioning on the steel with the heterogeneous distribution of Mn in the high-temperature austenite after cooling to a temperature between martensitic transformation start temperature and martensitic transformation finish temperature.

In some embodiments, the first heating rate is in a range of 1° C./s-200° C./s.

In some embodiments, the first temperature is in a range of 20° C.-200° C. above $Ac_3$, wherein $Ac_3$ is a critical temperature for completing austenite transformation.

In some embodiments, the first temperature is in a range of 700° C.-900° C.

In some embodiments, the first preset time is in a range of 0-200 s.

In some embodiments, the tempering includes obtaining the carbide-free tempered martensitic steel by cooling the steel with the heterogeneous distribution of Mn in the high-temperature austenite to the room temperature, heating to 150° C.-400° C., and holding for 0-120 min.

In some embodiments, the partitioning includes obtaining the carbide-free tempered martensitic steel by cooling the steel with the heterogeneous distribution of Mn in the high-temperature austenite to 50° C.-250° C. and holding for 0 s-60 s, heating to 100° C.-400° C. and holding for 1 min-240 min, and cooling to the room temperature; or obtaining the carbide-free tempered martensite steel by cooling the steel with heterogeneous distribution of Mn in the high-temperature austenite to 100° C.-300° C. and holding for 5 min-240 min, and cooling to the room temperature.

In some embodiments, the prefabricated product is selected from a pearlitic steel containing an Mn-rich cementite and an Mn-poor ferrite, wherein in the pearlitic steel, a morphology of the Mn-rich cementite is sphere or lamella and the Mn-rich cementite is distributed on the Mn-poor ferrite matrix; or a tempered steel containing an Mn-rich cementite and an Mn-poor tempered martensite matrix, wherein in the tempered steel, a morphology of the Mn-rich cementite is short rod and/or sphere and the Mn-rich cementite is distributed on the Mn-poor tempered martensite matrix; or a complex phase steel containing an Mn-rich austenite and a Mn-poor ferrite, wherein in the complex steel, a morphology of the Mn-rich austenite is block. In some embodiments, the atomic percentage of Mn in the Mn-rich cementite and the Mn-rich austenite is not less than 8 at. %.

In some embodiments, obtaining the Mn-rich pearlitic steel with the cementite in the morphology of lamella as the prefabricated product includes: heating the cast steel to 1200° C.-1250° C. and holding for 24 h-36 h for homogenization, and hot rolling to obtain a hot rolled plate; and heating the hot rolled plate to 800° C.-900° C. and holding for 5 min-60 min, and cooling to 450° C.-650° C. and holding for 3 h-36 h, and cooling to the room temperature. Obtaining the Mn-rich pearlitic steel with the cementite in the morphology of sphere as the prefabricated product includes: heating the cast steel to 1200° C.-1250° C. and holding for 24 h-36 h for homogenization, and hot rolling to obtain a hot rolled plate; and heating the hot rolled plate to 20° C.-30° C. above an austenite transformation start temperature and holding for 5 min-120 min, and cooling to 10° C.-30° C. below the austenite start transformation temperature and holding for 12 h-72 h, and cooling to the room temperature. Obtaining the tempered steel as the prefabricated product includes: heating the cast steel to 1200° C.-1250° C. and holding for 24 h-36 h for homogenization to obtain a hot rolled plate; and heating the hot rolled plate to an austenite and ferrite two-phase region temperature of 400° C.-700° C. and holding for 3 h-72 h, and cooling to the room temperature. Obtaining the complex phase steel with the Mn-rich austenite and the Mn-poor ferrite as the prefabricated product includes: heating the cast steel to 1200° C.-1250° C. and holding for 24 h-36 h for homogenization, and hot rolling to obtain a hot rolled plate; and heating the hot rolled plate to the austenite and ferrite two-phase region temperature of 500° C.-800° C. and holding for 4 h-72 h, and cooling to the room temperature.

In some embodiments, the carbide-free tempered martensitic steel includes a martensite matrix and a retained austenite distributed between the martensite matrix, wherein retained austenite with a volume fraction in the range of 10%-40% has a size of submicron or nanoscale and includes at least one of sphere, block, or film morphology.

In some embodiments, the carbide-free tempered martensitic steel includes Fe, C, and Mn elements, wherein a mass percentage of the C is in a range of 0.2%-1.0% and a mass percentage of the Mn is in a range of 2.0%-8.0%. The carbide-free tempered martensitic steel further includes at least one of: Si with a mass percentage of 0-3%, Al with a mass percentage of 0-3%, Cr with a mass percentage of 0-1.5%, Mo with a mass percentage of 0-0.5%, Ni with a mass percentage of 0-2%, Ti with a mass percentage of 0-0.1%, V with a mass percentage 0-0.5%, or Nb with a mass percentage of 0-0.5%.

In some embodiments, an atomic percentage of Mn in the retained austenite is greater than an atomic percentage of Mn in the martensite matrix, the atomic percentage of Mn in the retained austenite is greater than or equal to 4 at. %, and a difference in the atomic percentage of Mn between the retained austenite and the atomic percentage of martensite matrix is greater than 3 at. %.

BRIEF DESCRIPTION OF THE DRAWINGS

The present disclosure is further explained by way of example embodiments, which are described in detail by means of the accompanying drawings. These embodiments are not limiting, wherein.

DETAILED DESCRIPTION

Figure 1:
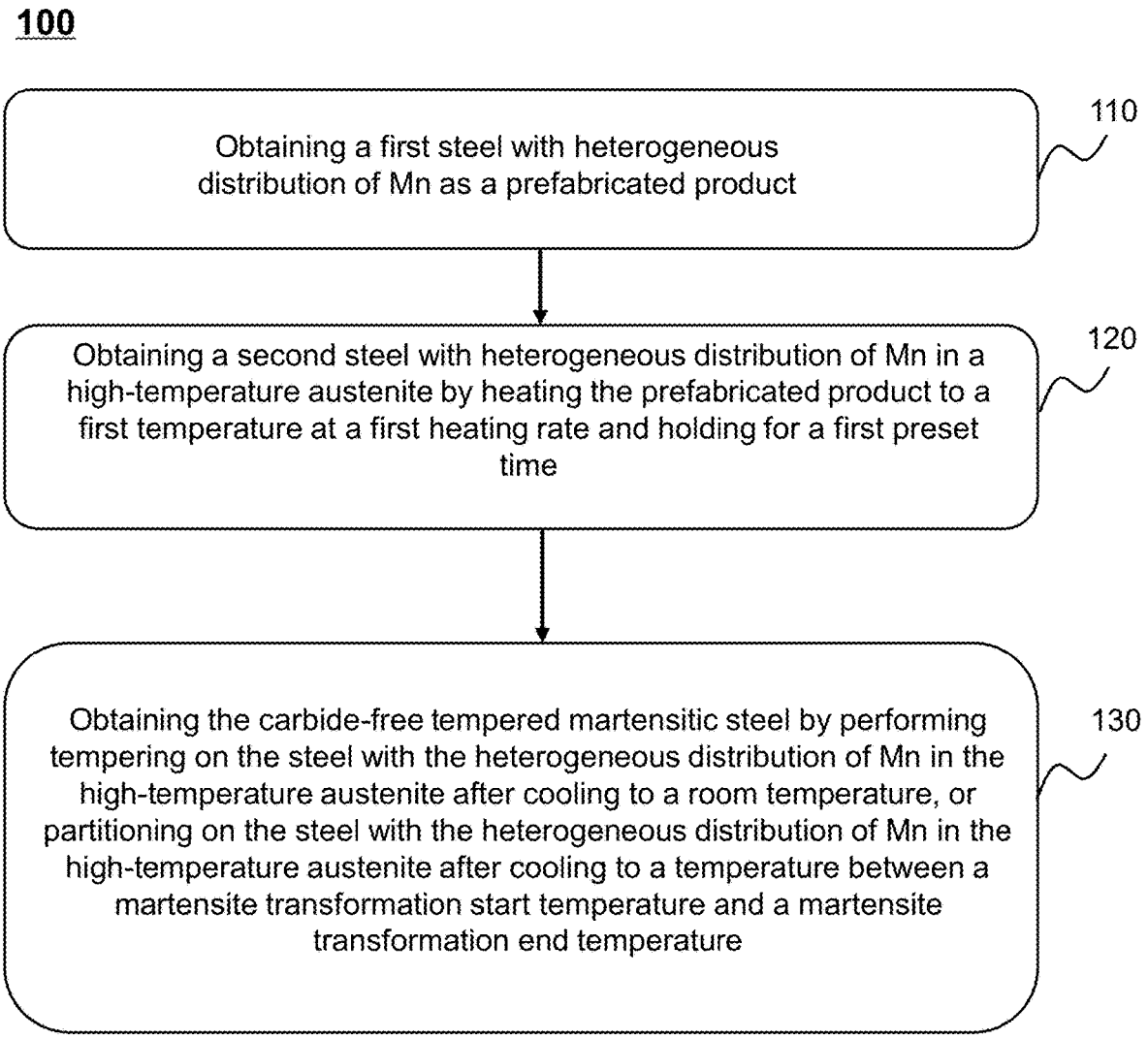
FIG. 1 is a flowchart illustrating an exemplary process of a method for preparing a carbide-free tempered martensitic steel according to some embodiments of the present disclosure.

In order to explain the technical solutions of the embodiments of the present disclosure more clearly, the accompanying drawings needed to be used in the description of the embodiments are briefly introduced below. Obviously, the drawings in the following description are only some examples or embodiments of the present disclosure. For those skilled in the art, without exerting any creative efforts, the present disclosure may also be applied to other similar scenarios based on these drawings. Unless obviously obtained from the context or the context illustrates otherwise, the same numeral in the drawings refers to the same structure or operation.

As shown in the present disclosure and claims, the singular forms "a," "an," and "the" include plural referents unless the content clearly dictates otherwise; the plural forms may be intended to include singular forms as well. In general, the terms "comprise," "comprises," and/or "comprising," "include," "includes," and/or "including," merely prompt to include steps and elements that have been clearly identified, and these steps and elements do not constitute an exclusive listing. The methods or devices may also include other steps or elements.

A microstructure of the carbide-free tempered martensitic steel provided in the embodiments of the present disclosure is a complex phase structure, including a martensite matrix and a retained austenite distributed between the martensite matrix. The carbide-free tempered martensitic steel is a steel obtained after tempering or partitioning. More descriptions of the tempering and partitioning may be found elsewhere in the present disclosure, which is not repeated herein.

In embodiments of the present disclosure, submicron refers to particle size in a range of 100 nm-1 μm, and nanoscale refers to particle size in a range smaller than 100 nm. A size of the retained austenite is submicron and/or nanoscale, which may be understood that the size of the retained austenite is in the range of 100 nm-1 μm, and/or smaller than 100 nm. In embodiments of the present disclosure, the size of sphere retained austenite and block retained austenite refers to an equivalent circular diameter, and the size of the film retained austenite refers to the thickness.

The retained austenite may include at least one morphology of sphere, block, or film. In some embodiments, the sphere may include, but is not limited to, round sphere, elliptical sphere, partial sphere (e.g., hemisphere), cylinder, pyramid, etc. The block may include, but is not limited to, tetrahedron, hexahedron, octahedron, etc.

A volume fraction of retained austenite refers to a volume of retained austenite as a percentage of the volume of carbide-free tempered martensitic steel. The volume fraction of the retained austenite is in a range of 10%-40%, which can improve the ductility of the carbide-free tempered martensitic steel. In some embodiments, the volume fraction of retained austenite may be in a range of 15%-40%. In some embodiments, the volume fraction of retained austenite may be in a range of 20%-40%.

In some embodiments, the volume fraction of retained austenite may be in a range of 25%-40%. In some embodiments, the volume fraction of retained austenite may be in a range of 30%-40%. In some embodiments, the volume fraction of retained austenite may be in a range of 35%-40%. In some embodiments, the volume fraction of retained austenite may be in a range of 15%-35%. In some embodiments, the volume fraction of retained austenite may be in a range of 20%-30%. In some embodiments, the volume fraction of retained austenite may be 10%, 20%, 30%, 40%, etc.

In some embodiments, an atomic percentage of Mn in retained austenite may be greater than or equal to 4 at. %. In some embodiments, the atomic percentage of Mn in retained austenite may be greater than or equal to 5 at. %. In some embodiments, the atomic percentage of Mn in retained austenite may be greater than or equal to 6 at. %. In some embodiments, the atomic percentage of Mn in retained austenite may be greater than or equal to 7 at. %. In some embodiments, the atomic percentage of Mn in retained austenite may be greater than or equal to 8 at. %. In some embodiments, the atomic percentage of Mn in retained austenite may be greater than or equal to 9 at. %. In some embodiments, the atomic percentage of Mn in retained austenite may be greater than or equal to 10 at. %. The atomic percentage of Mn refers to the count of Mn atoms in the retained austenite or a martensite as a percentage of the total count of atoms.

An atomic percentage of Mn in retained austenite may be greater than an atomic percentage of Mn in martensite matrix. In some embodiments, a difference in atomic percentage of Mn between the retained austenite and the martensite matrix is greater than 3 at. %. In some embodiments, the difference in atomic percentage of Mn between the retained austenite and the martensite matrix is greater than 3.5 at. %. In some embodiments, the difference in atomic percentage of Mn between the retained austenite and the martensite matrix is greater than 4 at. %. In some embodiments, the difference in atomic percentage of Mn between the retained austenite and the martensite matrix is greater than 4.5 at. %. In some embodiments, the difference in atomic percentage of Mn between the retained austenite and the martensite matrix is greater than 5 at. %. In some embodiments, the difference in atomic percentage of Mn between the retained austenite and the martensite matrix is greater than 5.5 at. %. In some embodiments, the difference in atomic percentage of Mn between the retained austenite and the martensite matrix is greater than 6 at. %. In some embodiments, the difference in atomic percentage of Mn between the retained austenite and the martensite matrix is greater than 6.5 at. %. In some embodiments, the difference in atomic percentage of Mn between the retained austenite and the martensite matrix is greater than 7 at. %. In some embodiments, the difference in atomic percentage of Mn between the retained austenite and the martensite matrix is greater than 8 at. %. In some embodiments, the difference in atomic percentage of Mn between the retained austenite and the martensite matrix is greater than 9 at. %. In some embodiments, the difference in atomic percentage of Mn between the retained austenite and the martensite matrix is greater than 10 at. %. In some embodiments, the difference in atomic percentage of Mn between the retained austenite and the martensite matrix is greater than 11 at. %. In some embodiments, the difference in atomic percentage of Mn between the retained austenite and the martensite matrix is greater than 12 at. %. In some embodiments, the difference in atomic percentage of Mn between the retained austenite and the martensite matrix is greater than 13 at. %. In some embodiments, the difference in atomic percentage of Mn between the retained austenite and the martensite matrix is greater than 14 at. %. In some embodiments, the difference in atomic percentage of Mn between the retained austenite and the martensite matrix is greater than 15 at. %.

A spacing between adjacent retained austenites may be understood as a smallest spacing between edges of adjacent retained austenites. In some embodiments, the center of the retained austenite may be a geometric center. In some embodiments, the spacing between adjacent retained austenites may be smaller than 2 μm. In some embodiments, the spacing between adjacent retained austenites may be smaller than 1.5 μm. In some embodiments, the spacing between adjacent retained austenites may be smaller than 1 μm. In some embodiments, the spacing between adjacent retained austenites may be smaller than 0.8 μm. In some embodiments, the spacing between adjacent retained austenites may be smaller than 0.6 μm. In some embodiments, the spacing between adjacent retained austenites may be smaller than 0.4 μm. In some embodiments, the spacing between adjacent retained austenites may be smaller than 0.2 μm. In some embodiments, the spacing between adjacent retained austenites may be smaller than 0.1 μm. In some embodiments, the spacing between adjacent retained austenites may be smaller than 0.05 μm.

In some embodiments, the carbide-free tempered martensitic steel may include Fe, C, and Mn elements. In some embodiments, the carbide-free tempered martensitic steel may also include at least one of Si, Al, Cr, Mo, Ni, Ti, V, or Nb elements. It is understood that the carbide-free tempered martensitic steel may include unavoidable impurities. The unavoidable impurities may include P, S, H, N, O elements, etc. In some embodiments, the carbide-free tempered martensitic steel may consist of Fe, C, Mn elements, and the unavoidable impurities.

In some embodiments, a mass percentage of C may be in a range of 0.2%-1.0%. In some embodiments, the mass percentage of C may be in a range of 0.3%-0.9%. In some embodiments, the mass percentage of C may be in a range of 0.4%-0.8%. In some embodiments, the mass percentage of C may be in a range of 0.5%-0.7%. In some embodiments, the mass percentage of C may be in a range of 0.6%-0.7%. In some embodiments, the mass percentage of C may be 0.2%, 0.4%, 0.6%, 0.8%, 1.0%, etc.

In some embodiments, a mass percentage of Mn may be in a range of 2.0%-8.0%. In some embodiments, the mass percentage of Mn may be in a range of 3.0%-7.0%. In some embodiments, the mass percentage of Mn may be in a range of 4.0%-6.0%. In some embodiments, the mass percentage of Mn may be in a range of 5.0%-6.0%. In some embodiments, the mass percentage of Mn may be 2.0%, 4.0%, 6.0%, 8.0%, etc.

In some embodiments, a mass percentage of Si may be in a range of 0-3%. In some embodiments, the mass percentage of Si may be in a range of 0.5%-2.5%. In some embodiments, the mass percentage of Si may be in a range of 1%-2%. In some embodiments, the mass percentage of Si may be in a range of 1.5%-2%. In some embodiments, the mass percentage of Si may be 0, 1%, 2%, 3%, etc.

In some embodiments, a mass percentage of Al may be in a range of 0-3%. In some embodiments, the mass percentage of Al may be in a range of 0.5%-2.5%. In some embodiments, the mass percentage of Al may be in a range of 1%-2%. In some embodiments, the mass percentage of Al may be in a range of 1.5%-2%. In some embodiments, the mass percentage of the Al may be 0, 1%, 2%, 3%, etc.

In some embodiments, a mass percentage of Cr may be in a range of 0-1.5%. In some embodiments, the mass percentage of Cr may be in a range of 0.2%-1.3%. In some embodiments, the mass percentage of Cr may be in a range of 0.4%-1.2%. In some embodiments, the mass percentage of Cr may be in a range of 0.6%-1.0%. In some embodiments, the mass percentage of Cr may be in a range of 0.7%-0.9%. In some embodiments, the mass percentage of Cr may be 0, 0.2%, 0.5%, 0.8%, 1.0%, 1.2%, 1.5%, etc.

In some embodiments, a mass percentage of Mo may be in a range of 0-0.5%. In some embodiments, the mass percentage of Mo may be in a range of 0.1%-0.4%. In some embodiments, the mass percentage of Mo may be in a range of 0.2%-0.3%. In some embodiments, the mass percentage of Mo may be 0, 0.2%, 0.4%, 0.5%, etc.

In some embodiments, a mass percentage of Ni may be in a range of 0-2%. In some embodiments, the mass percentage of Ni may be in a range of 0.2%-1.8%. In some embodiments, the mass percentage of Ni may be in a range of 0.4%-1.6%. In some embodiments, the mass percentage of Ni may be in a range of 0.6%-1.4%. In some embodiments, the mass percentage of Ni may be in a range of 0.8%-1.2%. In some embodiments, the mass percentage of Ni may be in a range of 1%-1.1%. In some embodiments, the mass percentage of Ni may be 0, 0.5%, 1%, 1.5%, 2%, etc.

In some embodiments, a mass percentage of Ti may be in a range of 0-0.1%. In some embodiments, the mass percentage of Ti may be in a range of 0.02%-0.08%. In some embodiments, the mass percentage of Ti may be in a range of 0.04%-0.06%. In some embodiments, the mass percentage of Ti may be in a range of 0.05%-0.06%. In some embodiments, the mass percentage of Ti may be 0, 0.01%, 0.03%, 0.05%, 0.07%, 0.09%, 0.1%, etc.

In some embodiments, a mass percentage of V may be in a range of 0-0.5%. In some embodiments, the mass percentage of V may be in a range of 0.1%-0.4%. In some embodiments, the mass percentage of V may be in a range of 0.2%-0.3%. In some embodiments, the mass percentage of V may be 0, 0.1%, 0.3%, 0.4%, 0.5%, etc.

In some embodiments, the mass percentage of Nb may be in a range of 0-0.5%. In some embodiments, the mass percentage of Nb may be in a range of 0.1%-0.4%. In some embodiments, the mass percentage of Nb may be in a range of 0.2%-0.3%. In some embodiments, the mass percentage of Nb may be 0, 0.1%, 0.3%, 0.4%, 0.5%, etc.

In some embodiments, a tensile strength of carbide-free tempered martensitic steel may be in a range of 1500 MPa-2200 MPa. In some embodiments, the tensile strength of carbide-free tempered martensitic steel may be in a range of 1600 MPa-2000 MPa. In some embodiments, the tensile strength of carbide-free tempered martensitic steel may be in a range of 1700 MPa-1900 MPa. In some embodiments, the tensile strength of carbide-free tempered martensitic steel may be in a range of 1700 MPa-1800 MPa. In some embodiments, the tensile strength of carbide-free tempered martensitic steel may be in a range of 1600 MPa-2200 MPa. In some embodiments, the tensile strength of carbide-free tempered martensitic steel may be in a range of 1700 MPa-2200 MPa. In some embodiments, the tensile strength of carbide-free tempered martensitic steel may be in a range of 1800 MPa-2200 MPa. In some embodiments, the tensile strength of carbide-free tempered martensitic steel may be in a range of 1900 MPa-2200 MPa. In some embodiments, the tensile strength of carbide-free tempered martensitic steel may be in a range of 2000 MPa-2200 MPa. In some embodiments, the tensile strength of carbide-free tempered martensitic steel may be in a range of 2100 MPa-2200 MPa.

In some embodiments, a total elongation of carbide-free tempered martensitic steel may be in a range of 10%-30%. In some embodiments, the total elongation of carbide-free tempered martensitic steel may be in a range of 20%-30%. In some embodiments, the total elongation of carbide-free tempered martensitic steel may be in a range of 18%-25%. In some embodiments, the total elongation of carbide-free tempered martensitic steel may be in a range of 10%-20%. In some embodiments, the total elongation of carbide-free tempered martensitic steel may be in a range of 10%-20%. In some embodiments, the total elongation of carbide-free tempered martensitic steel may be in a range of 10%-18%. In some embodiments, the total elongation of carbide-free tempered martensitic steel may be in a range of 10%-15%.

It should be noted that the above descriptions of carbide-free tempered martensitic steel is only for example and illustration, and does not limit the scope of application of the present disclosure. For those skilled in the art, various modifications and changes may be made to the carbide-free tempered martensitic steel under the guidance of the present disclosure. However, such modifications and changes remain within the scope of the present disclosure.

FIG. 1 is a flowchart illustrating an exemplary process of a method for preparing a carbide-free tempered martensitic steel according to some embodiments of the present disclosure.

The process 100 may be performed by one or more components in a device for preparing carbide-free tempered martensitic steel. In some embodiments, the process 100 may be performed automatically by a control system. For example, the process 100 may be implemented through a control instruction, and the control system controls each component to complete each operation of the process 100 based on the control instruction. In some embodiments, the process 100 may be performed semi-automatically. In some embodiments, when the process 100 is performed, one or more additional operations not described herein may be added, and/or one or more operations discussed herein may be omitted. As shown in FIG. 1, the process 100 may include following operations.

In 110, obtaining a first steel with heterogeneous distribution of Mn as a prefabricated product.

In some embodiments, the steel with heterogeneous distribution of Mn (i.e., the prefabricated product) may be selected from a pearlitic steel containing an Mn-rich cementite and an Mn-poor ferrite matrix, a tempered steel containing an Mn-rich cementite and an Mn-poor tempered martensite matrix, or a complex phase steel containing an Mn-rich austenite and an Mn-poor ferrite.

In some embodiments, the morphology of Mn-rich cementite in the pearlitic steel may be sphere or lamella. The Mn-rich cementite may be distributed on the Mn-poor ferrite matrix. In some embodiments, the volume fraction of pearlite in the pearlitic steel may be greater than or equal to 80%. In some embodiments, the volume fraction of pearlite in the pearlitic steel may be greater than or equal to 85%. In some embodiments, the volume fraction of pearlite in the pearlitic steel may be greater than or equal to 90%. In some embodiments, the volume fraction of pearlite in the pearlitic steel may be greater than or equal to 95%.

In some embodiments, the heat treatment process for obtaining Mn-rich pearlitic steel with cementite in the morphology of lamella as the prefabricated product includes that first, the cast steel is heated to 1200° C.-1250° C. and held for 24 h-36 h for homogenization, and then hot rolled to obtain a hot rolled plate; and secondly, the hot rolled plate is heated to 800° C.-900° C. and held for 5 min-60 min, and then cooled down to 450° C.-650° C. and held for 3 h-36 h, and finally cooled to a room temperature.

In some embodiments, the heat treatment process for obtaining Mn-rich pearlitic steel with cementite in the morphology of sphere as the prefabricated product includes that first, the cast steel is heated to 1200° C.-1250° C. and held for 24 h-36 h for homogenization, and then hot rolled to obtain a hot rolled plate; and secondly, the hot rolled plate is heated to 20° C.-30° C. above the austenite transformation start temperature and held for 5 min-120 min, and then cooled down to 10° C.-30° C. below the austenite transformation start temperature and held for 12 h-72 h, and finally cooled to the room temperature.

In some embodiments, the morphology of Mn-rich cementite in the tempered steel may be short rod and/or sphere. The Mn-rich cementite may be distributed on the Mn-poor tempered martensite matrix. In some embodiments, the heat treatment process for obtaining tempered steel as the prefabricated product includes that first, the cast steel is heated to 1200° C.-1250° C. and held for 24 h-36 h for homogenization, and then hot rolled to obtain a hot rolled plate; and secondly, the hot rolled plate is heated to 400° C.-700° C. and held for 3 h-72 h, and finally cooled to the room temperature.

In some embodiments, the morphology of the Mn-rich austenite in the complex phase steel may be block. In some embodiments, the heat treatment process for obtaining complex steel with Mn-rich austenite and Mn-poor ferrite as the prefabricated product includes that first, the cast steel is heated to 1200° C.-1250° C. and held for 24 h-36 h for homogenization, and then hot rolled to obtain hot rolled plate; and secondly, the hot rolled plate is heated to the austenite and ferrite two-phase region temperature of 500° C.-800° C. and held for 4 h-72 h, and then cooled to the room temperature.

In some embodiments, an atomic percentage of Mn in the Mn-rich cementite and/or the Mn-rich austenite may be not less than 8 at. %. In some embodiments, the atomic percentage of Mn in the Mn-rich cementite and/or the Mn-rich austenite may be not less than 10 at. %. In some embodiments, the atomic percentage of Mn in the Mn-rich cementite and/or the Mn-rich austenite may be not less than 15 at. %. In some embodiments, the atomic percentage of Mn in the Mn-rich cementite and/or the Mn-rich austenite may be not less than 20 at. %. In some embodiments, the atomic percentage of Mn in the Mn-rich cementite and/or the Mn-rich austenite may be not less than 25 at. %. In some embodiments, the atomic percentage of Mn in the Mn-rich cementite and/or the Mn-rich austenite may be not less than 30 at. %.

In 120, obtaining a second steel with heterogeneous distribution of Mn in the high-temperature austenite by heating the prefabricated product to a first temperature at a first heating rate and holding for a first preset time.

In some embodiments, the first heating rate may be in a range of 1° C./s-200° C./s. In some embodiments, the first heating rate may be in a range of 1° C./s-30° C./s. In some embodiments, the first heating rate may be in a range of 10° C./s-100° C./s. In some embodiments, the first heating rate may be in a range of 40° C./s-150° C./s. In some embodiments, the first heating rate may be in a range of 60° C./s-200° C./s. In some embodiments, the first heating rate may be in a range of 100° C./s-200° C./s.

In some embodiments, the first temperature may be in a range of 20° C.-200° C. above $Ac_3$. The $Ac_3$ is a critical temperature for completing austenite transformation. In some embodiments, the first temperature may be in a range of 700° C.-900° C. In some embodiments, the first temperature may be in a range of 720° C.-880° C. In some embodiments, the first temperature may be in a range of 740° C.-860° C. In some embodiments, the first temperature may be in a range of 760° C.-840° C. In some embodiments, the first temperature may be in a range of 780° C.-820° C. In some embodiments, the first temperature may be in a range of 800° C.-820° C.

In some embodiments, the first preset time may be in a range of 0-200 s. In some embodiments, the first preset time may be in a range of 0-40 s. In some embodiments, the first preset time may be in a range of 20 s-80 s. In some embodiments, the first preset time may be in a range of 40 s-140 s. In some embodiments, the first preset time may be in a range of 80 s-160 s. In some embodiments, the first preset time may be in a range of 100 s-200 s. The first preset time may be in a range of 60 s-90 s. The first preset time may be in a range of 70 s-80 S.

In the embodiments of the present disclosure, diffusion of Mn in the prefabricated product may be limited through fast heating (e.g., at the first heating rate) and short-time (e.g., the first preset time) austenitization, thereby obtaining the steel with heterogeneous distribution of Mn in the high-temperature austenite.

In 130, the steel with heterogeneous distribution of Mn in the high temperature austenite is tempered after cooling to the room temperature or partitioned after cooling cooled to a temperature between the martensite transformation start temperature and the martensite transformation finish temperature to obtain the carbide-free tempered martensitic steel.

In the embodiments of the present disclosure, the room temperature refers to 25° C.±5° C., or in a range of 20° C.-30° C.

In some embodiments, the tempering treatment may include: cooling the steel with heterogeneous distribution of Mn in the high-temperature austenite to the room temperature, then heating up to 150° C.-400° C., and holding for 0 min-120 min to obtain the carbide-free tempered martensite steel.

In some embodiments, the temperature between the martensite transformation start temperature and the martensite transformation finish temperature may be in a range of 50° C.-400° C. In some embodiments, the temperature between the martensite transformation start temperature and the martensite transformation finish temperature may be in a range of 50° C.-200° C. In some embodiments, the temperature between the martensite transformation start temperature and the martensite transformation finish temperature may be in a range of 100° C.-300° C. In some embodiments, the temperature between the martensite transformation start temperature and the martensite transformation finish temperature may be in a range of 200° C.-400° C. In some embodiments, the temperature between the martensite transformation start temperature and the martensite transformation finish temperature may be 50° C., 100° C., 150° C., 200° C., 250° C., 300° C., 350° C., or 400° C.

In some embodiments, the partitioning treatment may include: cooling the steel with heterogeneous distribution of Mn in the high-temperature austenite to 50° C.-250° C. and holding for 0-60 s, then heating up to 100° C.-400° C. and holding for 1 min-240 min, and finally cooling to the room temperature to obtain the carbide-free tempered martensitic steel. In some embodiments, the partitioning treatment may also include: cooling the steel with heterogenous distribution of Mn in the high-temperature austenite to 100° C.-300° C., and holding for 5 min-240 min, and finally cooling to the room temperature to obtain the carbide-free tempered martensite steel.

For more descriptions regarding the microstructure, composition, and properties of carbide-free tempered martensitic steel, please refer to elsewhere in the present disclosure, which will not be repeated here.

It should be noted that the above descriptions of the method for preparing the carbide-free tempered martensitic steel is only for example and illustration, and does not limit the scope of application of the present disclosure. For those skilled in the art, various modifications and changes may be made to the method for preparing the carbide-free tempered martensitic steel under the guidance of the present disclosure. However, such modifications and changes remain within the scope of the present disclosure.

Embodiment 1

The carbide-free tempered martensitic steel was prepared as follows.

(1) The steel with the composition of Fe-0.37C-3.73Mn-0.6Si—0.8Ni (where the unit is wt. %) was vacuum melted and forged. The steel is homogenized at 1200° C. for 36 h in order to eliminate Mn segregation and hot rolled to a thickness of 7 mm with a final rolling temperature greater than 850° C. to obtain hot rolled plate with martensitic microstructure. The hot rolled plate was heated to 600° C. and held for 24 hours to obtain the prefabricated steel. Mn-rich spherical cementite particles in the prefabricated steel were evenly distributed on the martensite matrix.

(2) The obtained prefabricated steel was heated to 800° C. at a rate of 80° C./s, and held for 10 s, followed by water quenching to room temperature.

(3) The steel obtained in step (2) was reheated to 200° C., tempered for 60 min and water quenched to the room temperature, and the carbide-free tempered martensitic steel was obtained.

Figure 2A:
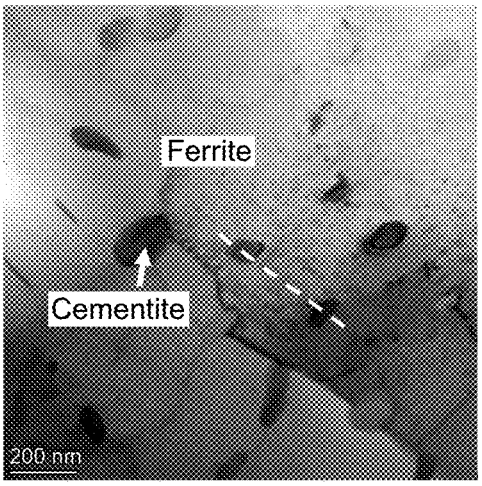
FIG. 2A illustrates an exemplary Transmission Electron Microscope (TEM) image of a prefabricated steel in Embodiment 1.
Figure 2B:
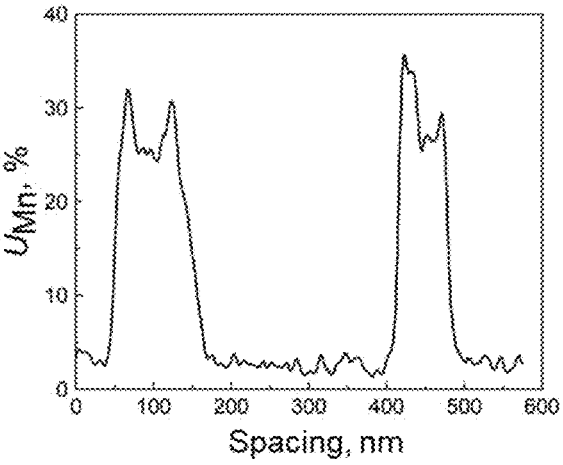
FIG. 2B shows an Mn element distribution and a spacing between cementite and ferrite of the prefabricated steel in Embodiment 1.

The microstructure of the prefabricated steel obtained in this embodiment is shown in FIG. 2A. It may be seen that the Mn-rich spherical cementite in the prefabricated steel were homogeneous distributed on the martensite matrix. The distribution of Mn (the step size of 0.3 nm), size, and spacing of phase were measured using a transmission electron microscope (TEM) equipped with electron dispersive X-ray spectroscopy (The same method is used for the relevant data in the following embodiment). It may be seen from FIG. 2B that the average atomic percentage of Mn in the cementite is greater than 25 at. %, and an average spacing between cementites is approximately 380 nm. It indicates that the hot rolled plate precipitated cementite and spheroidization after long-term heat treatment, and the Mn continued to slowly diffuse from the martensite into the cementite, and eventually the formation of Mn-rich spherical cementite particles and Mn-poor martensite matrix.

The relatively large heating rate and short-time austenitization adopted in step (2) may ensure that both spherical cementite and martensite are transformed into austenite, while avoiding long-range diffusion of Mn in the cementite, and maintain the heterogeneous distribution of Mn in the high-temperature austenite. After rapid cooling, the microstructure of the steel was transformed into the complex phase microstructure with the martensite matrix in which nano-sized retained austenite is diffusely distributed. The average atomic percentage of Mn in the retained austenite was greater than 9 at. %, and the atomic percentage of Mn in the martensite matrix was about 2.8 at. %. The difference in Mn concentration between retained austenite and martensite matrix was 6.2 at. %, which was far exceeding 3 at. %. The size of the nano spherical austenite was about 60 nm and the average spacing between the retained austenites was only 360 nm. Therefore, the spherical austenite inherited the heterogeneous distribution of Mn and spacing of the original spherical cementite.

Figure 3A:
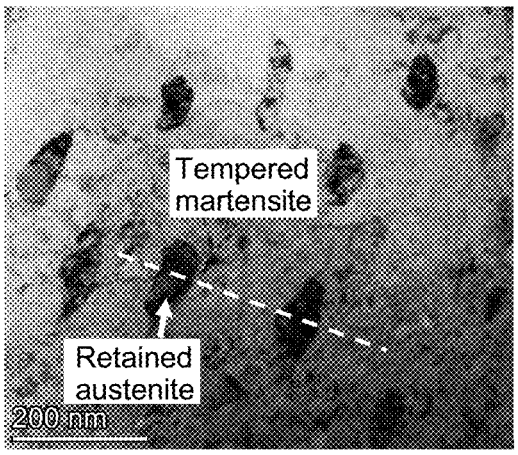
FIG. 3A is a TEM image of a steel obtained after step (3) in Embodiment 1.
Figure 3B:
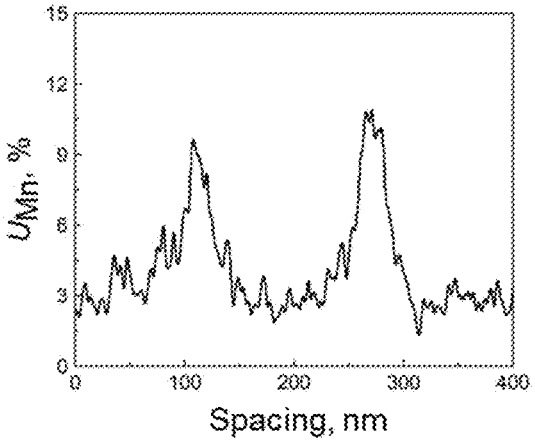
FIG. 3B shows an Mn element distribution and a spacing between austenite and martensite of the prefabricated steel in Embodiment 1.

The distribution of Mn remained unchanged during the tempering in step (3). Duo to the high Mn content in spherical austenite is relatively high and the spacing between the Mn-rich austenite and the small spacing between Mn-rich retained austenites, the carbon in the martensite tends to diffuse into Mn-rich retained austenite rather than it precipitates as carbide. The microstructure of the steel obtained in step (3) is shown in FIG. 3A. It may be seen that the spherical retained austenite is distributed on the martensite matrix, and there is no obvious carbide precipitation in the martensite. It shows that the sufficient difference of Mn concentration and the small spacing enable the spherical austenite formed from the spherical cementite to effectively inhibit carbide precipitation during tempering. At the same time, the retained austenite with high content of up to 15% was finally obtained. Due to the high stability of nano-spheroidal austenite, the TRIP effect can be better exerted during the tensile process, so that the total elongation is 14.5% under the tensile strength of 1975 MPa.

Comparative Embodiment 1

The hot rolled plate having the martensite microstructure with Mn homogeneous was heat as in steps (2) and (3) of Embodiment 1 to obtain the comparison sample.

Figure 4:
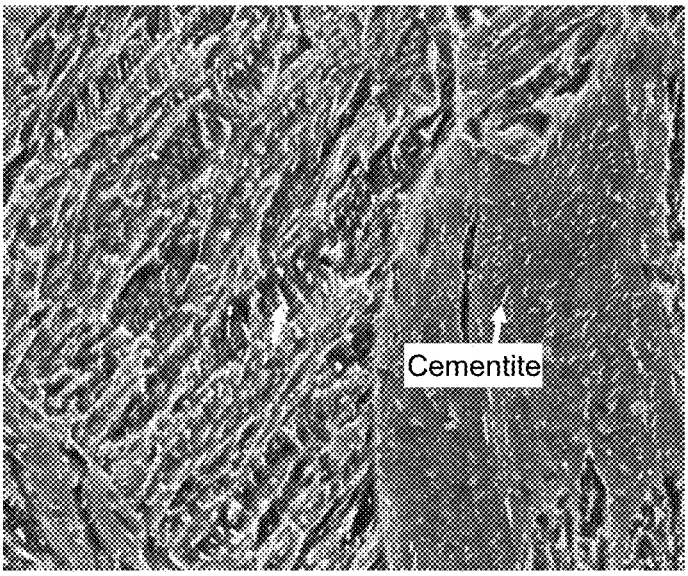
FIG. 4 is a Scanning Electron Microscope (SEM) image of a comparison sample in Embodiment 1.

The Scanning Electron Microscope (SEM) image of the comparison sample is shown in FIG. 4. It may be seen that the comparison sample precipitated a large amount of carbide on the lath martensite, the volume fraction of retained austenite is 5.6%, and the tensile strength was 1921 MPa with a total elongation of 10%.

By comparing Embodiment 1 and Comparative Embodiment 1, it may be seen that the technical solution of the present disclosure may completely inhibit carbide precipitation, and significantly increase the retained austenite content of steel, thereby improving ductility of the steel.

Embodiment 2

The carbide-free tempered martensitic steel was prepared as follows.

(1) The steel with the composition of Fe-0.2C-7.3Mn-0.5Ni-0.2Mo (where the unit is wt. %) was vacuum melted and forged. The steel is homogenized at 1250° C. for 24 h in order to eliminate Mn segregation and hot rolled to a thickness of 7.5 mm with a final rolling temperature greater than 850° C. to obtain hot rolled plate with martensitic microstructure. The hot rolled plate was annealed for 8 hours at 600° C. in the austenite and ferrite two-phase region to obtain the prefabricated steel. The steel has a two-phase microstructure composed of Mn-rich block austenite and Mn-poor ferrite.

(2) The obtained prefabricated steel was heated to 780° C. at the heating rate of 80° C./s and held for 6 s, following by water quenching to the room temperature.

(3) The carbide-free tempered martensitic steel obtained in step (2) was reheated to 300° C., tempered for 60 s and water quenched to room temperature.

The prefabricated steel obtained in this embodiment formed the two-phase microstructure composed of Mn-rich block austenite and Mn-poor ferrite. After rapid heating and short-time austenitization adopted in step (2), the ferrite and austenite was transformed into the single-phase austenite at high temperature and retain the heterogeneous distribution of Mn in the high-temperature austenite. In the subsequent cooling process, the austenite transformed from Mn-poor ferrite is transformed into martensite while Mn-rich austenite is retained, resulting in the formation of the complex phase microstructure of Mn-rich block austenite and Mn-poor martensite. The Mn-rich block retained austenite inherited the heterogeneous distribution of Mn and spacing of the original austenite. The atomic percentage of Mn in the retained austenite was about 10%, the spacing between adjacent retained austenites was 460 nm, and the atomic percentage of Mn in the martensite matrix was about 2.6%.

The difference between the atomic percentage of Mn in retained austenite and martensite matrix was much more than 3%.

Figure 5A:
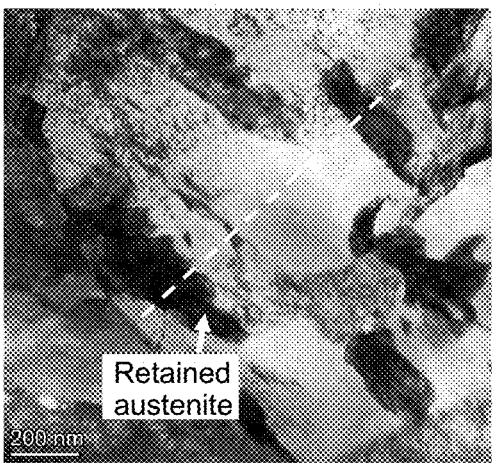
FIG. 5A is a TEM image of a steel obtained after step (3) in Embodiment 2.
Figure 5B:
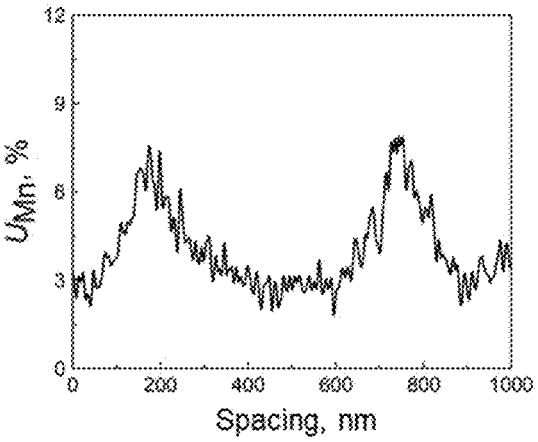
FIG. 5B shows an Mn element distribution and a spacing between austenite and martensite of the prefabricated steel in Embodiment 2.

The distribution of Mn remained unchanged during the tempering in step (3), so that carbon in the martensite tends to be diffusion into retained austenite, thereby inhibiting the precipitation of carbide. As shown in FIG. 5A, Mn-rich block retained austenite and Mn-poor martensite without carbide was obtained. As shown in FIG. 5B, the average volume fraction of block retained austenite was 38%, and the size of block retained austenite was in a range of 50 nm-400 nm. Retained austenites with different size and content of Mn has different stability and can be continuously transformed to provide work hardening under different strains, culminating in a total elongation of 25% at a tensile strength of 1560 MPa.

Embodiment 3

The carbide-free tempered martensitic steel was prepared as follows.

(1) The steel with the composition of Fe-0.37C-4.2Mn-0.5Al-0.3Cr (where the unit is wt. %) was vacuum melted and forged. The steel is homogenized at 1250° C. for 24 h in order to eliminate Mn segregation and hot rolled to a thickness of 7.5 mm with a final rolling temperature greater than 850° C. to obtain hot rolled plate with martensitic microstructure. The hot rolled plate was heated in the resistance furnace at 820° C. for 15 min for austenitization, then moved to the salt-bath furnace at 580° C. for 6 h to complete pearlite transformation, and then to obtain the prefabricated steel.

(2) The obtained prefabricated steel was heated to 770° C. for 10 sat a heating rate of 5° C./s, and cooling to room temperature by air cooling or water cooling. In the air cooling, the cooling rate between 750° C. and 240° C. was about 7° C./s, and the cooling rate below 240° C. was about 0.6° C./s. In the water cooling, the cooling rate was approximately 226° C./s.

(3) The steel obtained in step (2) was reheated to 200° C. for 30 min, and then water quenched to room temperature to the carbide-free tempered martensitic steel.

The prefabricated steel obtained in this embodiment was lamellar pearlite composed of Mn-rich lamellar cementite and Mn-poor lamellar ferrite. The atomic percentage of Mn in lamella cementite was about 20 at. %, while the atomic percentage of Mn in lamellar ferrite was approximately 2 at. %.

After rapid heating and short-time austenitization adopted in step (2), the complex phase microstructure composed of Mn-rich film retained austenite and Mn-poor lath martensite was obtained. The atomic percentage of Mn in the Mn-rich film austenite was about 11 at. %, and the atomic percentage of Mn in the martensite matrix was about 3 at. %. the difference in atomic percentage of Mn between Mn-rich film austenite content and martensite matrix was much more than 3 at. %, and the film spacing between the Mn-rich retained austenites was inherited from the spacing between the lamellar cementites, which was only 160 nm. When the critical temperature of martensite transformation was reached, Mn-poor austenite was the first transformed into the martensite. Due to the slow cooling rate at low temperature, carbon was continuously enriched from the newly formed martensite to nearby Mn-rich austenite, which stabilized more retained austenite. The volume fraction of retained austenite reached 12.6%, compared to 11% after direct water cooling to room temperature.

Figure 6:
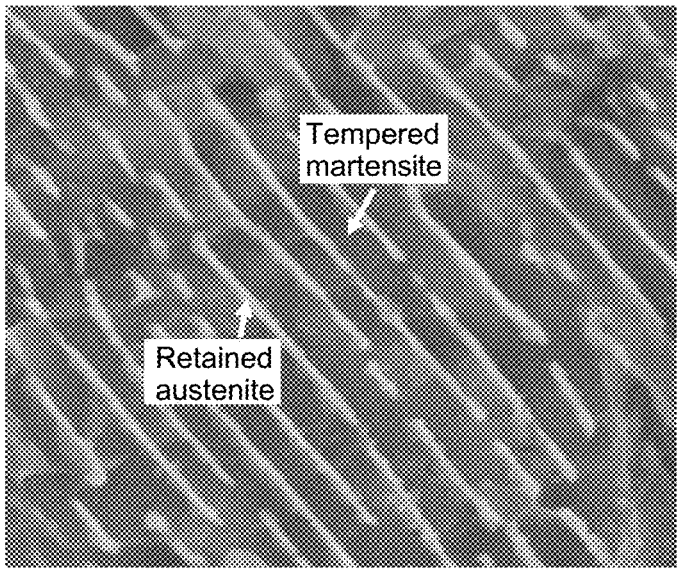
FIG. 6 is an SEM image of a steel obtained after step (3) in Embodiment 3.

The microstructure after the air cooling in step (2) and the tempering in step (3) is shown in FIG. 6, including the complex phase microstructure composed of Mn-rich film retained austenite and Mn-poor lath martensite without carbide overlapping each other. The size of retained austenite was 42 nm, which inherits the lamellar pearlitic shape of the precursor of the step. The distribution of Mn remained unchanged during the tempering, resulting in no carbide precipitation in the tempered martensite. At the same time, due to further diffusion of carbon in the martensite into the nearby retained austenite during tempering, the interface of the martensite/retained austenite continued to move to the martensite's side, resulting in a further increase in volume fraction of retained austenite to 14.4%, which was significantly higher than the volume fraction of retained austenite in the sample obtained by water cooling (8.5%).

Figure 7A:
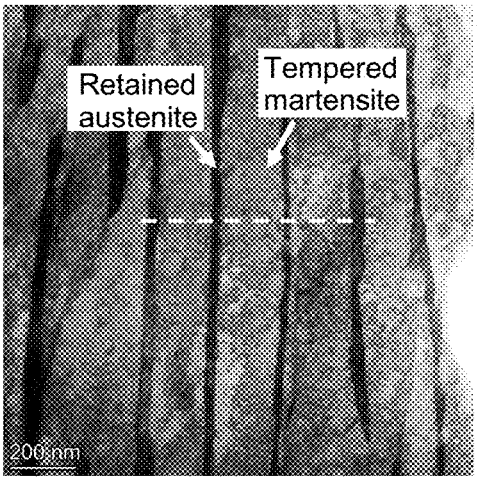
FIG. 7A is a TEM image of a steel obtained after step (3) in Embodiment 3.
Figure 7B:
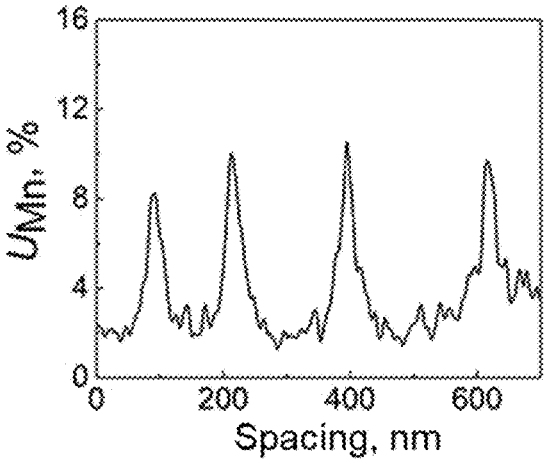
FIG. 7B shows an Mn element distribution and a spacing between austenite and martensite of the prefabricated steel in Embodiment 3.

FIG. 7A is a TEM image of the steel obtained after step (3) in Embodiment 3. As shown in FIG. 7A, it is further illustrated demonstrated that there is no carbide precipitated in the tempered martensite. Mainly due to the sufficient concentration difference of Mn and the extremely small diffusion distance between retained austenite and martensite. The Mn-rich retained austenite continuously absorbs carbon from the surrounding martensite by the interaction of Mn and C, which inhibits the precipitation of carbide. The final mechanical properties were maintained at the same strength as the directly quenched specimens (2000 MPa), and the slowly cooled sample with higher retained austenite content resulted in an increase of 61.7% in uniform elongation (from 4.7% to 7.6%) and 27.3% in total elongation (from 11% to 14%).

Embodiment 4

The carbide-free tempered martensitic steel was prepared as follows.

(1) The steel with the composition of Fe-0.37C-4.2Mn-0.5Al-0.3Cr (where the unit is wt. %) was vacuum melted and forged. The steel is homogenized at 1250° C. for 24 h in order to eliminate Mn segregation and hot rolled to a thickness of 6 mm with a final rolling temperature greater than 850° C. to obtain hot rolled plate with martensitic microstructure. The hot rolled plate was heated in the resistance furnace at 630° C. for 60 min for austenitization, then moved to the salt-bath furnace at 590° C. for 72 h to pearlite transformation, and then to obtain the prefabricated steel. quenched by water to the room temperature, and the prefabricated steel was obtained.

(2) The obtained prefabricated steel was heated to 850° C. at a heating rate of 30° C./s, and held for 10 s, followed by water cooled to room temperature.

(3) The steel obtained in step (2) was reheated to 200° C., tempered for 30 min, and then water quenched to room temperature to obtained the carbide-free tempered martensitic steel.

The prefabricated steel obtained in this embodiment was a spherical pearlite composed of Mn-rich spherical cementite and Mn-poor ferrite matrix. The atomic percentage of Mn in spherical cementite was approximately 26 at. %, and the atomic percentage of Mn in ferrite matrix was approximately 1.8 at. %.

After rapid heating and short-time austenitization adopted in step (2), the complex phase microstructure composed of Mn-rich spherical retained austenite and Mn-poor lath martensite was obtained. The atomic percentage of Mn in Mn-rich spherical austenite was about 13 at. %, and the atomic percentage of Mn in martensite matrix was about 2.9 at. %. The difference in atomic percentage of Mn between spherical austenite and martensite matrix was much more than 3 at. %, and the film spacing of Mn-rich retained austenites was inherited from lamellar cementite, which was only 320 nm. When the critical temperature of martensite transformation was reached, the Mn-poor austenite was first transformed into the martensite, and the complex phase microstructure composed of spherical austenite and martensite matrix was finally obtained. The average size of retained austenite was 85 nm and the volume fraction of retained austenite was 15%.

The difference of Mn in concentration after tempering in step (3) of this embodiment made carbide-free tempered martensite. The final mechanical properties were the tensile strength of 2057 MPa and the total elongation of 15.3%.

Embodiment 5

The carbide-free tempered martensitic steel was prepared as follows.

(1) The steel with the composition of Fe-0.37C-3.73Mn-0.6Si—0.8Ni (where the unit is wt. %) was vacuum melted and forged. The steel is homogenized at 1200° C. for 36 h in order to eliminate Mn segregation and hot rolled to a thickness of 6 mm with a final rolling temperature greater than 850° C. to obtain hot rolled plate with martensitic microstructure. The hot rolled plate was heated in the resistance furnace at 600° C. for 24 h to obtain the prefabricated steel. The Mn-rich cementite particles in the prefabricated steel were evenly distributed on ferrite matrix.

(2) Quenching-partitioning was performed on the refinished steel, which included: the steel was first heated to 800° C. at a heating rate of 80° C./s, and held for 10 s, then cooled to 130° C. at a rate of 20° C./s, and held for 60 s, followed by reheated to 220° C., holding it for 90 min, and finally water quenched to room temperature.

Figure 8A:
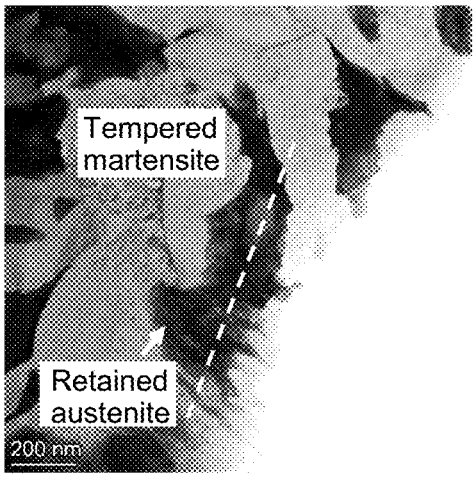
FIG. 8A is a TEM image of a steel obtained after step (2) in Embodiment 5.
Figure 8B:
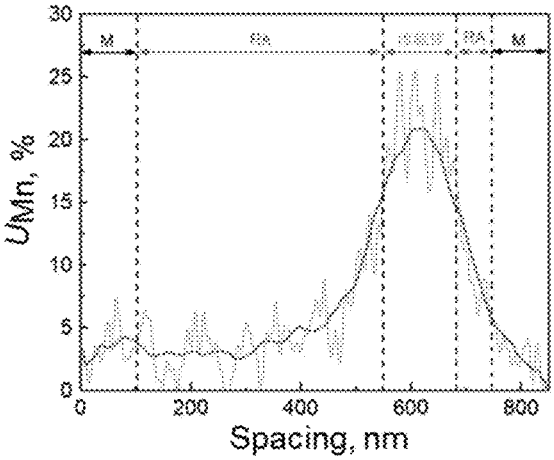
FIG. 8B shows an Mn element distribution and a spacing between austenite and martensite of the prefabricated steel in Embodiment 5.

The microstructure in step (2) is shown in FIG. 8A, which shows that there is no carbide precipitated in the martensitic steel after the partitioning. The Mn-rich retained austenite was mainly in the morphology of heterogeneous block, and some of them still remained spherical. The size of Mn-rich retained austenite was in a range of 40 nm-500 nm, and the average size was about 150 nm. It showed that the continuous carbon partitioning from martensite to austenite makes a part of the austenite with the low Mn region stably retained at the room temperature after partitioning, thus forming spherical and block retained austenite under the stable action of carbide. The quenching-partitioning (Q&P) process significantly increased the volume fraction of retained austenite to 28%. Compared with Embodiment 1, the extended Q&P process more than doubled the volume fraction of retained austenite with a variety of morphologies and scales, resulting in an increase in ductility to 18.6% while maintaining a high tensile strength (2000 MPa).

Embodiment 6

The carbide-free tempered martensitic steel was prepared as follows.

(1) The steel with the composition of Fe-0.42C-4.48Mn (where the unit is wt. %) was vacuum melted and forged. The steel is homogenized at 1250° C. for 24 h in order to eliminate Mn segregation and hot rolled to a thickness of 6 mm with a final rolling temperature greater than 850° C. to obtain hot rolled plate with martensitic microstructure. The hot rolled plate was heated in the resistance furnace at 800° C. for 10 min to austenitization, then moved to a salt bath furnace at 570° C. and held for 6 h for complete pearlite transformation, and finally water quenched to room temperature to obtain the prefabricated steel.

(2) The prefabricated steel was heated to 750° C. at a heating rate of 5° C./s and held for 20 s, subsequently cooled to 200° C. and held for 30 min, finally water quenched to room temperature.

(3) The steel in step (2) was reheated to 200° C., tempered for 60 min to obtain the carbide-free tempered martensitic steel.

When quenched to 200° C. in step (2), the unstable austenite was transformed into martensite, while the Mn-rich austenite was remained. The continuous carbon partitioning from martensite to austenite is able to stabilize more austenite. The final microstructure after step (3) was similar to the microstructure of Embodiment 3, wherein the atomic percentage of Mn in austenite was approximately 11 at. %, and the atomic percentage of Mn in martensite matrix was approximately 3 at. %. The difference in atomic percentage of Mn between austenite and martensite matrix was much more than 3 at. %. The film spacing between Mn-rich retained austenites was 150 nm. Unusually, the average size of the retained austenite increases to 55 nm when stabilized by elemental carbon, resulting in a significant increase in the volume fraction of retained austenite (from 14.4% to 19%). Finally, the strong and ductility match between the tensile strength of 1958 MPa and the total elongation of 15.6% was obtained. Similarly, no carbides precipitated in the martensite even in the absence of Si and Al.

It should be noted that the above embodiments are only examples, and the process parameters involved may be different in different embodiments. The order of the above steps is not unique. In different embodiments, the order of the steps may also be adjusted, or even a certain step or multiple steps may be omitted. The above embodiments should not be construed as limiting the scope of the present disclosure.

The possible beneficial effects of the embodiments of the present disclosure include but are not limited to: (1) Compared with carbide precipitated in conventional martensite steel and Q&P steel, the present disclosure innovatively utilizes heterogeneous distribution of Mn in the high-temperature austenite to break through the research paradigm of martensitic steel, and innovatively develops a new Fe—C—Mn carbide-free tempered martensitic steel; (2) The embodiments of the present disclosure forms the Mn-rich austenite and the Mn-poor martensite at low temperature using the heterogeneous distribution of Mn in the high-temperature austenite, and promotes the partition of carbon from Mn-poor martensite to Mn-rich austenite through the strong interaction between Mn and C, which can completely inhibit carbide precipitation even without Si and Al. Thus, the defects of Si and Al alloying and alloy cost are reduced; (3) Unlike conventional tempered martensitic steel or Q&P steel, the carbide-free tempered martensitic steels of the embodiments of the present disclosure; on the one hand, eliminates potential risks of carbide becoming cracks or holes during deformation; on the other hand, the complete inhibition of carbide promotes the diffusion of C from martensite to austenite, thereby satisfying an optimal partitioning state. At the same time, the present disclosure realizes the synergy between C and Mn to stabilize the austenite, thereby greatly increasing the content and stability of retained austenite, which is conducive to improving ductility and toughness; (4) Through the embodiments of the present disclosure, the inventor unexpectedly found that, although Mn has a strong attraction for carbon, resulting in the enrichment of carbon to Mn-rich retained austenite. However, this interaction is limited due to the competition of carbides. When the Mn concentration difference between retained austenite and martensite or the Mn concentration of austenite is smaller than a certain value, the attraction of the Mn-rich austenite to carbon in martensite may be significantly weakened, and the carbide precipitation may not be completely inhibited. In addition, the increase of spacing between Mn-rich austenites means that the distance for carbon diffusion from martensite to austenite increases. When this distance exceeds a certain range, the carbide precipitation may still exist in martensite. In the embodiments of the present disclosure, the carbon is more fully enriched in austenite by adjusting the atomic percentage of Mn and distance of austenites, thereby ensuring that there is no carbide precipitated in the tempered martensite; and (5) The method for preparing the carbide-free tempered martensitic steel in the embodiments of the present disclosure may obtain retained austenites with various morphologies, multi-scales, and multi-stabilities by regulating the structure type of the heterogeneous Mn distribution precursor, which may further regulate the content of retained austenite in a large range of 10% to 40%, and expanding the process window of industrial production, thereby further effectively improving the ductility of steel. It should be noted that different embodiments may have different beneficial effects. In different embodiments, the possible beneficial effects may include any combination of one or more of the above, or any other possible beneficial effects that may be obtained.

Having thus described the basic concepts, it may be rather apparent to those skilled in the art after reading this detailed disclosure that the foregoing detailed disclosure is intended to be presented by way of example only and is not limiting. Although not explicitly stated here, those skilled in the art may make various modifications, improvements and amendments to the present disclosure. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various parts of this specification are not necessarily all referring to the same embodiment. In addition, some features, structures, or features in the present disclosure of one or more embodiments may be appropriately combined.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. However, this disclosure does not mean that the present disclosure object requires more features than the features mentioned in the claims. Rather, claimed subject matter may lie in less than all features of a single foregoing disclosed embodiment.

In some embodiments, the numbers expressing quantities or properties used to describe and claim certain embodiments of the present disclosure are to be understood as being modified in some instances by the term "about," "approximate," or "substantially." For example, "about," "approximate," or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the present disclosure are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the present disclosure disclosed herein are illustrative of the principles of the embodiments of the present disclosure. Other modifications that may be employed may be within the scope of the present disclosure. Thus, by way of example, but not of limitation, alternative configurations of the embodiments of the present disclosure may be utilized in accordance with the teachings herein. Accordingly, embodiments of the present disclosure are not limited to that precisely as shown and described.

What is claimed is:

1. A method for preparing a carbide-free tempered martensitic steel, comprising:

(1) obtaining a first steel with heterogeneous distribution of Mn as a prefabricated product;

(2) obtaining a steel with heterogeneous distribution of Mn in a first-temperature austenite by heating the prefabricated product to the first temperature at a rate of 1-200° C./s and holding for 0-200 s, wherein the first temperature is in a range of 20° C.-200° C. above $Ac_3$, and the $Ac_3$ is a critical temperature for complete transformation of austenite; and (3) obtaining the carbide-free tempered martensitic steel by performing partitioning on the steel with heterogeneous distribution of Mn in the first-temperature austenite after cooling to a temperature between a martensite transformation start temperature and a martensite transformation finish temperature;

wherein a microstructure of the carbide-free tempered martensitic steel includes Mn-rich austenite and Mn-poor martensite, and an atomic percentage of Mn in the Mn-rich austenite is not less than 4 at. %, a difference of Mn concentration between the Mn-rich austenite and the Mn-poor martensite is greater than 3 at. %, and a distribution spacing between the Mn-rich austenite is less than 2 μm, wherein the partitioning in step (3) includes: obtaining the carbide-free tempered martensitic steel by cooling the steel with heterogeneous distribution of Mn in the first-temperature austenite to 130° C. at a rate of 20° C./s and holding for 60 s, heating to 220° C. and holding for 90 min, and cooling to room temperature.

2. The method of claim 1, wherein the 20° C.-200° C. above $Ac_3$ is in a range of 700° C.-900° C.

3. The method of claim 1, wherein the prefabricated product is selected from:

a pearlitic steel containing an Mn-rich cementite and an Mn-poor ferrite matrix, wherein a morphology of the Mn-rich cementite is sphere or lamella and the Mn-rich cementite is distributed on the Mn-poor ferrite matrix; a tempered steel containing an Mn-rich cementite and an Mn-poor tempered martensite matrix, wherein a morphology of the Mn-rich cementite is short rod and/or sphere and the Mn-rich cementite is distributed on the Mn-poor tempered martensite matrix; and a complex phase steel containing an Mn-rich austenite and an Mn-poor ferrite, wherein the Mn-rich austenite is polygonal.

4. The method of claim 3, wherein the obtaining the pearlitic steel with the Mn-rich cementite in the morphology of lamella includes heating a cast steel to 1200° C.-1250° C. and holding for 24 h-36 h for homogenization, and hot rolling to obtain a hot rolled plate; and heating the hot rolled plate to 800° C.-900° C. and holding for 5 min-60 min, cooling to 450° C.-650° C. and holding for 3 h-36 h, and cooling to room temperature to obtain the prefabricated product;

the obtaining the pearlitic steel with the Mn-rich cementite in the morphology of sphere includes heating the cast steel to 1200° C.-1250° C. and holding for 24 h-36 h for homogenization, and hot rolling to obtain a hot rolled plate; and heating the hot rolled plate to 20° C.-30° C. above the austenite transformation start temperature and holding for 5 min-120 min, and cooling to 10° C.-30° C. below the austenite transformation start temperature and holding for 12 h-72 h, and cooling to room temperature to obtain the prefabricated product.

5. The method of claim 3, wherein the obtaining the tempered steel includes heating the cast steel to 1200° C.-1250° C. and holding for 24 h-36 h for homogenization to obtain a hot rolled plate; and heating the hot rolled plate to an austenite and ferrite two-phase region temperature of 400° C.-700° C. and holding for 3 h-72 h, and cooling to room temperature to obtain the prefabricated product; and obtaining the complex phase steel includes heating the cast steel to 1200° C.-1250° C. and holding for 24 h-36 h for homogenization and hot rolling to obtain a hot rolled plate; and heating the hot rolled plate to the austenite and ferrite two-phase region temperature of 500° C.-800° C. and holding for 4 h-72 h, and cooling to room temperature to obtain the prefabricated product.

6. The method of claim 1, wherein the cast steel contains Fe element, 0.2-1.0 wt. % of C element, 2.0-8.0 wt. % of Mn element, and one or more of the following elements: Si: 0-3 wt. %, Al: 0-3 wt. %, Cr: 0-1.5 wt. %, Mo: 0-0.5 wt. %, Ni: 0-2 wt. %, Ti: 0-0.1 wt. %, V: 0-0.5 wt. %, Nb: 0-0.5 wt. %.

7. The method of claim 3, wherein an atomic percentage of Mn element in the Mn-rich cementite and the Mn-rich austenite of the prefabricated product is not less than 8 at. %.

* * * * *